United States Patent [19]

Watts et al.

[11] 4,214,705

[45] Jul. 29, 1980

[54] APPARATUS FOR CLEANING TANKS

[75] Inventors: Grady Watts, Vero Beach, Fla.; Michael Robinson, Malvern, England

[73] Assignee: Chemdet Sonic Systems, Inc., Port Washington, N.Y.

[21] Appl. No.: 970,555

[22] Filed: Dec. 18, 1978

[51] Int. Cl.[2] ..... B05B 3/02

[52] U.S. Cl. ..... 239/227

[58] Field of Search ..... 239/227, 246, 263, 225, 239/226, 305; 134/167 R, 171, 172

[56] References Cited

U.S. PATENT DOCUMENTS

| | | | |
|---|---|---|---|
| 2,681,250 | 6/1954 | Metcalf et al. | 239/227 |
| 2,773,721 | 12/1956 | Pedrick | 239/227 X |
| 3,416,732 | 12/1968 | Reiter | 239/227 |
| 3,637,138 | 1/1972 | Rucker | 239/227 |
| 3,902,670 | 9/1975 | Koller et al. | 239/227 |

FOREIGN PATENT DOCUMENTS

| | | | |
|---|---|---|---|
| 212950 | 5/1968 | U.S.S.R. | 239/227 |

*Primary Examiner*—Johnny D. Cherry
*Attorney, Agent, or Firm*—George B. Oujevolk

[57] ABSTRACT

An apparatus for cleaning tanks which is inserted into an opening at the top of the tank to be cleaned. The apparatus has an elongated cylindrical housing with an upper fluid inlet portion and a lower portion having a cylindrical rotary member coupled for rotation to the housing. The apparatus includes an air motor in the upper portion. In the lower portion, the main component is a high pressure block with an elongated axial aperture and a plurality of feed tubes disposed parallel to the axial aperture are held by the block. There is a central rotating vertical main tube in the central aperture which carries high pressure liquid. At the end of the high pressure block is a bevel housing gear and a nozzle tube is coupled at right angles to the central vertical tube. This nozzle tube has vertically disposed spray nozzles at one end and a bevel gear at the other end which is engaged with the bevel housing gear. In the central part of the cylindrical housing are gear and pinion shafts parallel to the central axis including one shaft axially aligned in coincidence with the central vertical axis. The air motor has a drive pinion on its output shaft which drives a gear train held on the gear and pinion shafts. The air motor drives the gear train which turns the central rotating vertical main tube and also turns the nozzle tube coupled to it. As the nozzle tube turns, the tube bevel gear engaged with the housing bevel gear is caused to turn which turns the nozzle tube. As the nozzle tube turns it turns the nozzles at the outer end of the nozzle tube.

10 Claims, 11 Drawing Figures

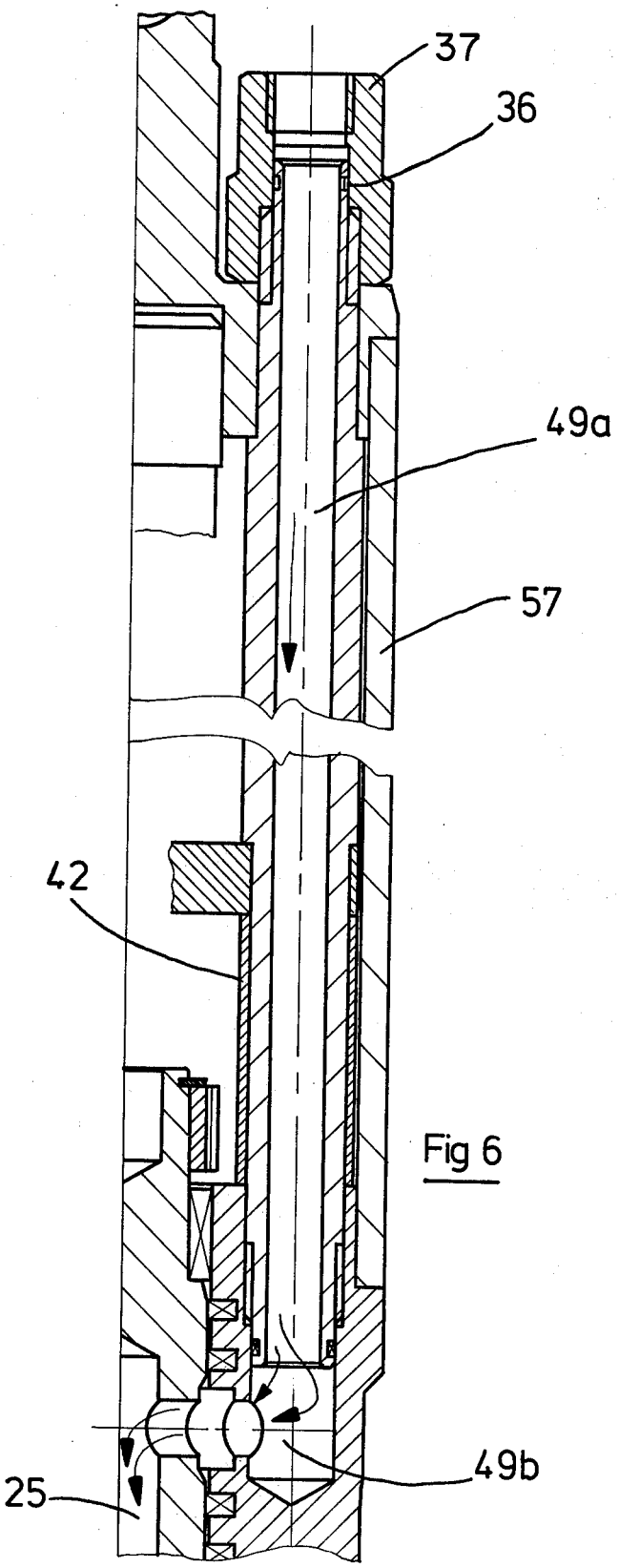
Fig 6
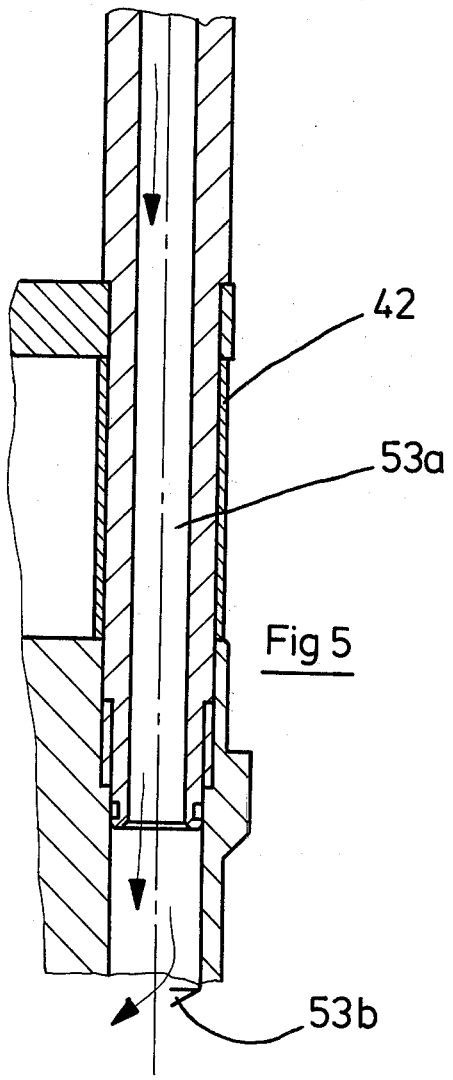
Fig 5
Fig 5

APPARATUS FOR CLEANING TANKS

BACKGROUND OF THE INVENTION

The present invention relates to tank cleaning units, and more particularly to a unit used in cleaning large tank trucks which is mechanically balanced and capable of cleaning difficult-to-clean tanks by remaining in the tank in a cleaning mode of operation over an extended period of time.

BRIEF DESCRIPTION OF THE PRIOR ART

Tank cleaning units of the type contemplated herein have been described in the G. Watts U.S. Pat. No. 3,281,269 and the G. Watts U.S. Pat. No. 3,401,060. As described in this prior art, the tank cleaning units are inserted through apertures in the top of the tank and include an elongated housing which extends down into the tank. The unit has at least one nozzle assembly at the end of the unit which revolves in both the horizontal and vertical planes. However, the units presently in use have several defects to which the present invention is directed.

At the outset is the insoluble problem of size. The tank inlets are quite small so that to have the greatest utility, the unit must be capable of fitting into the smallest possible tank size opening. The tanks are constructed with the contents in view and not the cleaning problem in view. Thus, it is the cleaning unit which must be accomodated to the tank. The cleaning units therefore have a very small diameter. Tremendous pressure must be used to blow cleaning fluids to all corners of the tanks. Unless the unit is properly constructed, i.e., mechanically balanced, the units develop vibrations during use and tend to fly apart.

The revolving nozzle assembly at the end of the unit revolves in two axes and thus requires bearings and gearing to carry out this rotation. This assembly must nevertheless be compact, have proper support, and not be subject to stress caused by fluid turbulance as the fluids rush through the unit. Separate feed lines must be provided for the various fluids used in the unit and these lines must be so disposed as not to unbalance the unit.

It must be remembered that the operator outside the unit cannot see the action taking place within the tank. If the construction of the unit is naturally unbalanced, it will make noise. Thus, the operator is unable to tell from the sound of the unit if it is functioning properly. What is needed is a balanced unit which will revolve within the tank in proper mechanical balance. Furthermore, lubrication for the unit must be so supplied that the lubricating oils do not contaminate the tank being cleaned.

SUMMARY OF THE INVENTION

Broadly stated, the apparatus contemplated herein for cleaning tanks has an elongated cylindrical housing with an upper fluid inlet portion and a lower portion having a cylindrical rotary member coupled for rotation to the housing. The apparatus includes an air motor in the upper portion. In the lower portion, the main component is a high pressure block with an elongated axial aperture and a plurality of feed tubes disposed parallel to the axial aperture are held by the block. This central aperture holds a central rotating main vertical tube which carries high pressure liquids. At the lower end of said high pressure block is a bevel housing gear and a nozzle tube is coupled at right angles to the central vertical tube. This nozzle tube has vertically disposed spray nozzles at one end and a bevel gear at the other end which is engaged with the bevel housing gear. In the central part of the cylindrical housing are parallel gear and pinion shafts which are also parallel to the central axis including one shaft axially aligned in coincidence with said central vertical axis. The air motor has a drive pinion on its outer shaft which drives a gear train held on the gear and pinion shafts. The air motor drives the gear train which turns the central rotating vertical main tube which in turn, turns the nozzle tube coupled to it. As the nozzle tube turns, the tube bevel gear engaged with the housing bevel gear is caused to turn. As the nozzle tube turns, it turns the nozzles at the outer end of the nozzle tube.

The invention as well as other objects and advantages thereof will be more readily understood from the following detailed description when taken together with the accompanying drawings, in which:

BRIEF DESCRIPTION OF THE DRAWINGS

FIG. 5 depicts a longitudinal cross-sectional view of the unit along lines 5—5 of FIG. 3 illustrating sonic air flow;

FIG. 6 shows a longitudinal cross-sectional view of the unit along lines 6—6 of FIG. 3 showing high pressure liquid flow;

DETAILED DESCRIPTION

Figure 1:
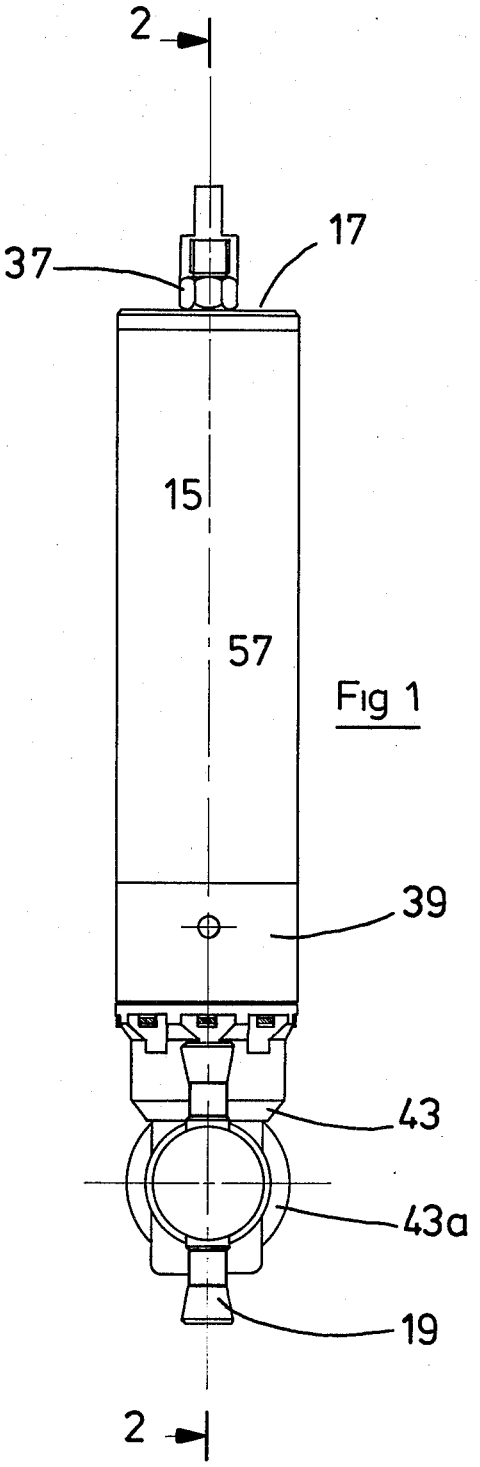
FIG. 1 shows an outer front view of the unit contemplated herein.
Figure 2:
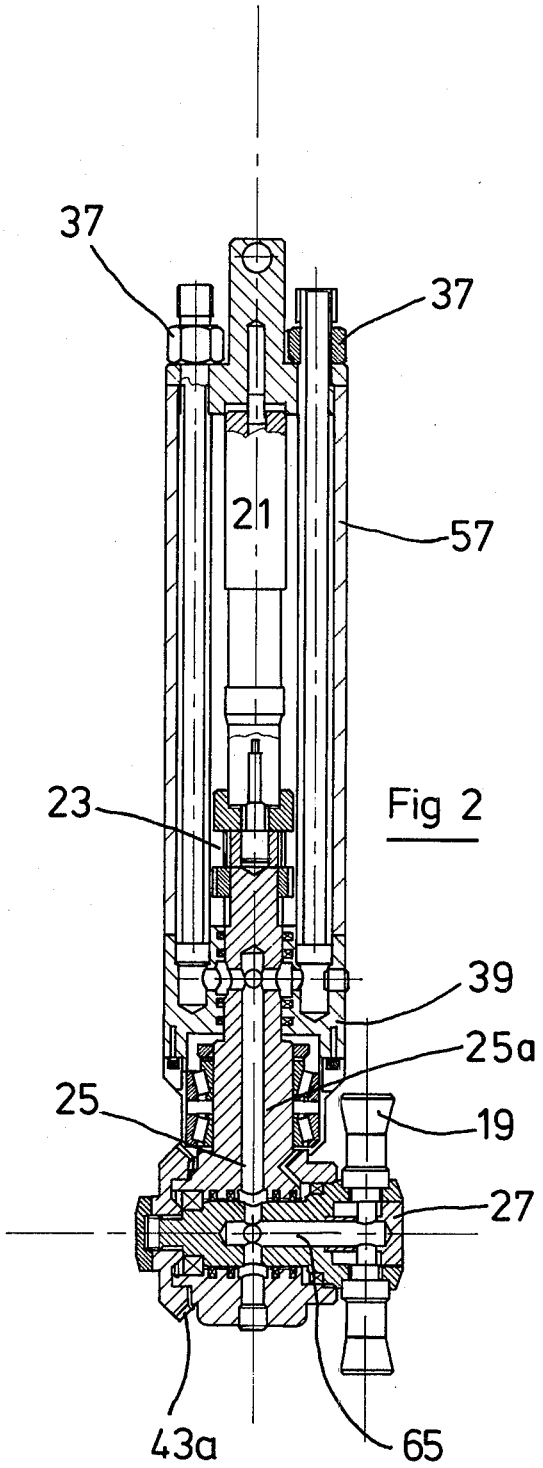
FIG. 2 is a cross sectional view along lines 2—2 of FIG. 1.
Figure 7:
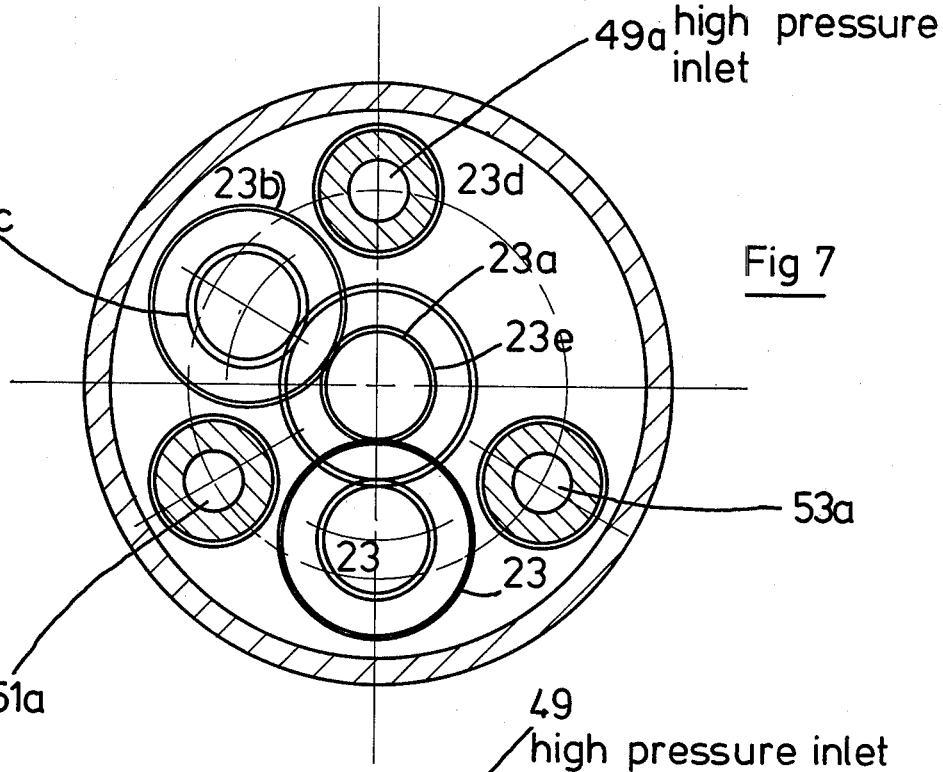
FIG. 7 provides a theoretical explanation in a sectional view through the center of FIG. 1 of the operation of the gear train as seen from the top.
Figure 3:
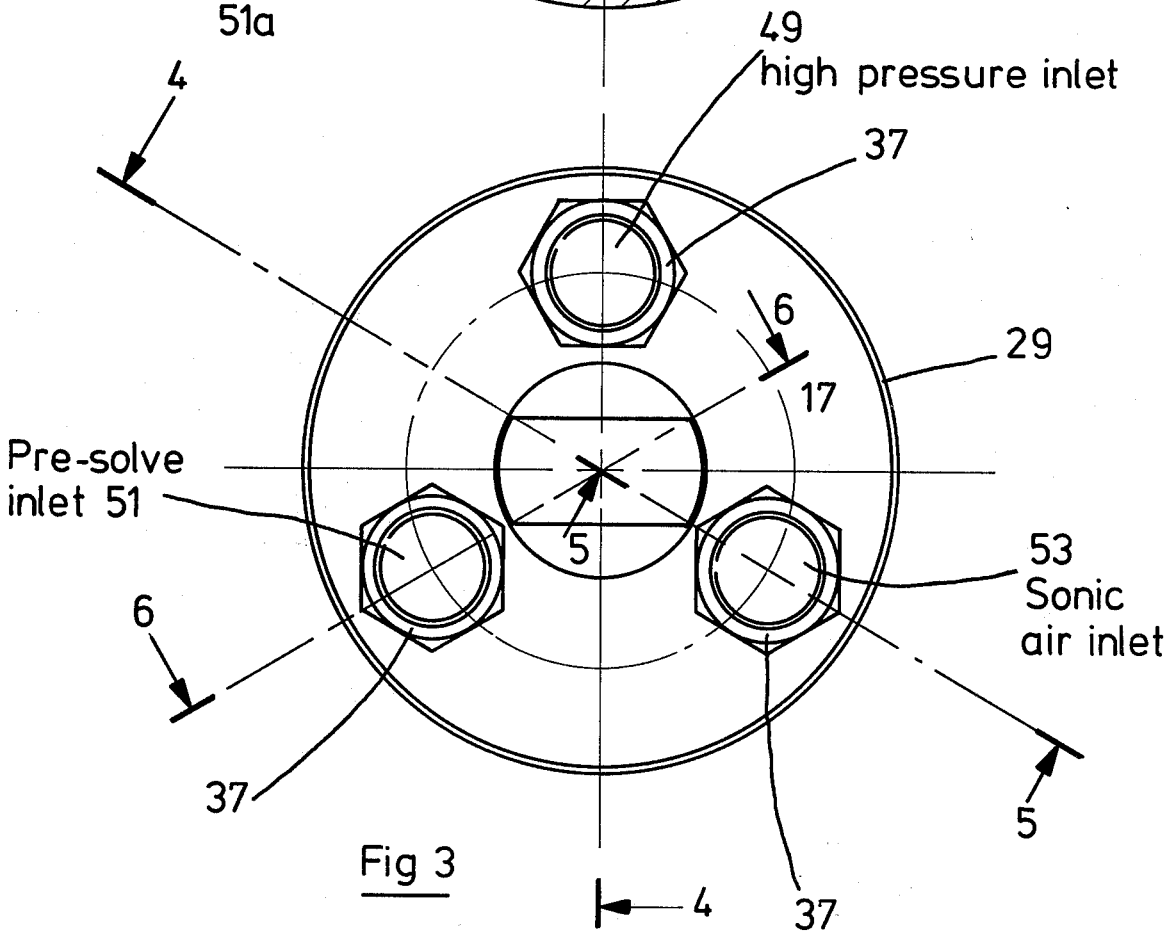
FIG. 3 is a top end view of the inlet side of the unit shown in FIG. 1.

The unit herein described in detail generally comprises the following components:

(I) The overall unit and cylindrical housing 15 which is to be inserted into a tank to be cleaned and the high pressure block at the end of the unit.

(II) The air motor 21 and gearing 23 to turn the horizontal rotating components.

(III) The flow lines including the fluid inlet end at the top of the unit which feeds a plurality of fluid passages in the unit carrying the fluids to the end nozzles 19.

(IV) The horizontally rotating main vertical tube held by the housing 15 and the high pressure block which is turned by the air motor 21; and, (V) The vertically rotating spray nozzle assembly 27 which will rotate the end nozzles 19 in the vertical plane and its gearing.

As depicted in FIGS. 1 to 4 there is first an end cap 29 over an air motor 21 which has an inner key 33 fed by working air through an air connection 34. The motor air is exhausted at the top end of the unit at a motor air exhaust 35. The end cap 29 fits over an o-ring 36 and is in turn held by bolts 37. Air motor 21 is coupled to a gear 23*a* forming part of a gear train 23 which will be described later in detail.

One of the cornerstones of construction is the high pressure block 39 with four internal grooves with seals 41. The high pressure block 39 terminates in a bevel gear housing 43. This block 39 has a central vertical aperture 25*a* which holds the central vertical main tube 25 for rotation in the horizontal plane. Block 39 also holds feed tube connections and it is properly positioned from the gear plate by means of sleeve spacers 42. At the outer end of block 39 is nozzle assembly 27 which turns around housing bevel gear 43 in the vertical plane.

The longitudinal portions of the feed tubes terminate in the high pressure block at feed tube connections and in this end of the unit are also machined recesses to take the three needle bearings 55 which support the ends of the gear shafts.

The high pressure block 39 is machined from solid 4 inch diameter stainless steel. Into block 39 are cut four internal grooves to receive seals 41. Pressures in this area are high, upward of 5000 psi. Between each pair of seals 41 is drilled a hole connecting to the atmosphere. In the event that the first line seal fails, then the pressure is relieved to the outside of the unit before it has a chance to build up behind the second seal. The bearings thus have a double protection against the pressure entering into them. Into one end of block 39 are threaded the feed tubes 49*a*, 51*a*, 53*a* to feed tube connections. O-rings are fitted at both ends of these tubes to prevent leakage.

THE AIR MOTOR AND GEARING

Covering the whole of the motor and gearbox area is the outer tube 57 which fits over the end of the block 39 and is clamped into place at the other end by end cap 29. Three bolts 37 secure the assembly together. O-rings are fitted into the outer tube to seal the can assembly.

The end cap 29 retains the air motor 21 in position. It is important that the air motor be easily replaceable and the design is such that when the cap is removed, the motor can be taken out quickly, and a replacement fitted. The air for this motor is not fed through the feed lines feeding fluid to the nozzles but is supplied by a separate connection in the end cap. This air connector 34 is fastened into the end of the motor. Air connector 34 has a seal and is off center to prevent the air motor from turning when driving the mechanism.

The bolts 37 securing the end cap in place are adapted to take the external connections required for the various liquid supplies to the unit. The air motor has an internal gear reduction to give the shaft a speed of 43 rpm. This has to be reduced further for the final drive to the nozzles. This is achieved by a triple reduction gear train 23.

The gear train 23 is so designed as to be in balance in the unit. The arrangement of the gear train can best be understood by a study of FIGS. 4, 7, 8*a* and 8*b*. Pinion 23*a* is locked on the end of the air motor shaft by a key 33 and a set screw. Parallel to the housing cylindrical axis are two gear shafts 22 and 24, while extending from and in the same plane as the air motor shaft is a central gear shaft 26. Set on the same axis as the motor shaft and gear shaft 26 is driven gear 23*h* coupled for rotating the main vertical tube 25. Driven gear 23*b* and pinion 23*c* are on shaft 22; gear 23*d* and pinion 23*e* are on shaft 26 while gear 23*f* and pinion 23*g* are on shaft 24.

Thus, drive pinion 23*a* on the motor drive shaft is coupled to drive gear 23*b* on the same shaft as pinion 23*c*, but spaced apart therefrom sufficiently so that pinion 23*e* is axially between gear 23*b*, and pinion 23*c*. Pinion 23*c* drives gear 23*d* on the same shaft as pinion 23*e* located immediately above it. Pinion 23*e* drives gear 23*f* which is on the same shaft as pinion 23*g*. Pinion 23*g* drives driven gear 23*h* which turns the main vertical tube 25. Gear 23*d* is axially between gear 23*f* and pinion 23*g*. Pinion 23*g* is juxtapositioned opposite gear 23*h* driving the main vertical tube 25. Between the air motor, the gear train and the feed tubes is a gear plate 59.

The final gear 23*h* is located in place by a snap ring. This gear is prevented from free rotation by a collapsible ring fitted into a groove which is deformed by the gear 23*h* being forced over it. This allows gear 23*h* to rotate the main vertical tube 25 but has enough resiliency in it should there be a shock load transmitted up from the nozzles through the mechanism. By adjusting the slip of the ring, the controlled slipping clutch effect can be obtained. The total reduction in speed given by this gear train is 6.5:1. The final speed of rotation therefore is approximately 6½ rpm depending on the air pressure. This is estimated to give the correct nozzle movement to allow the jet to clean most effectively. The control of the speed can be adjusted either by restricting the air input to the motor, or by maintaining the air constant and throttling the exhaust. The air motor exhaust discharges into the space surrounded by the outer tube 57. There are several reasons for this. The air supply to this motor is required to include oil mist to lubricate the internal parts of the motor. This oil will be carried over into the exhaust and will also be used to lubricate the gear train hereinbefore described. It may be that the oil in the air may contaminate the tank being cleaned and it must be possible to carry it away to exhaust outside the vessel. A tapped connection is made into the end cap 29 for this purpose. If a restriction device is also fitted into this exhaust it will serve to control the speed of the air motor. Also if this restriction is adjusted, the inside of the can outer tube 57 can be slightly pressurised during the operation and thus preventing the entry of any aggressive liquids from the outside during the cleaning operation.

THE FLOW LINES AND FEED TUBES

Figure 4:
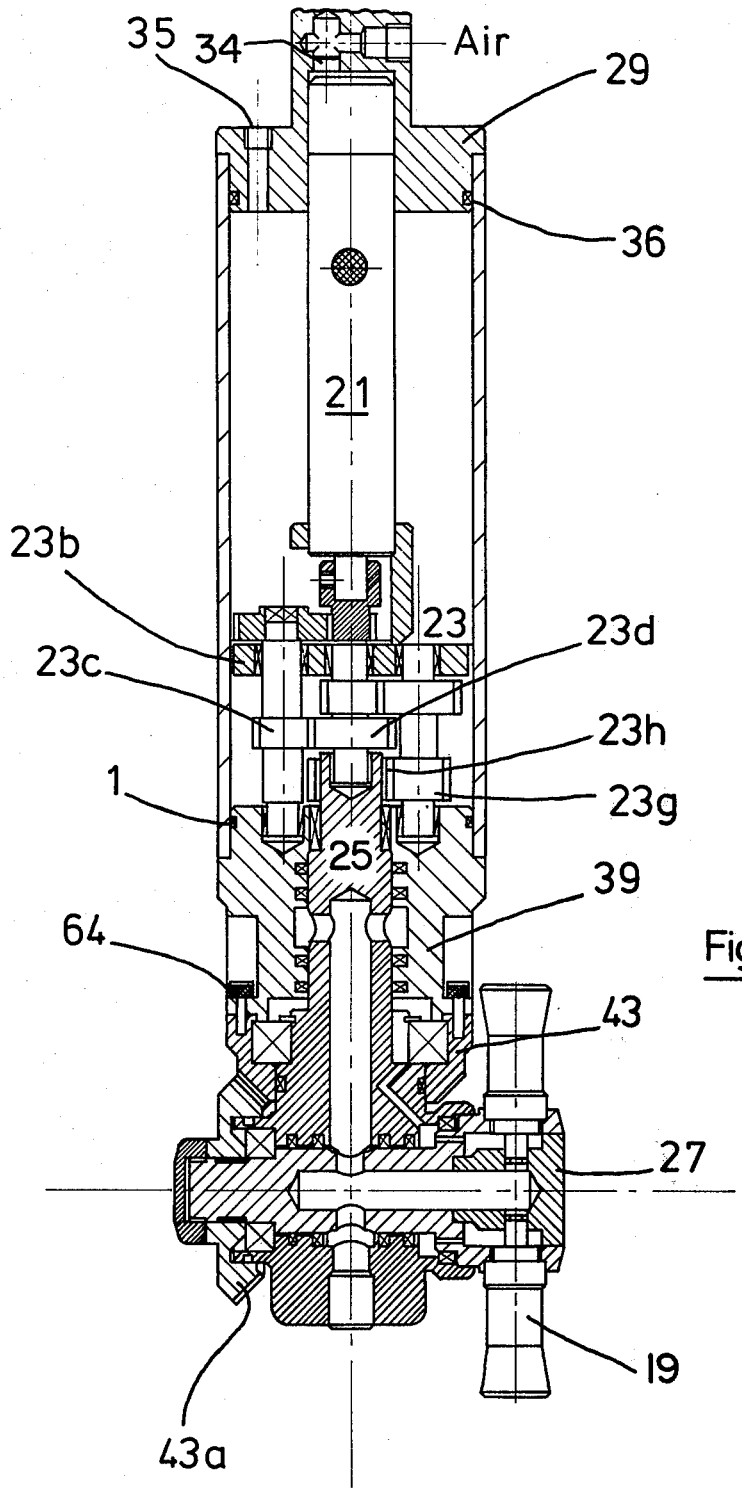
FIG. 4 presents a longitudinal cross-sectional view of the unit along lines 4—4 of FIG. 3 showing the principal components of the unit.

The overall unit just described uses at least three types of fluids: (1) air for the air motor 21; (2) detergents and other liquids used in cleaning, washing and otherwise spraying the interior of the tank to be cleaned; and, (3) sonic air to force the liquids out of the sonic nozzles. All fluids are fed from the inlet end 17 as shown in FIG. 4. The air for the air motor 21 is fed through a special inlet port to an air connector 34. The other inlets include a high pressure inlet port 49, a presolve inlet port 51, and a sonic air inlet port 53. Each inlet port opens into the respective lines, i.e., high pressure line 49*a*, presolve line 51*a* and sonic air line 53*a* shown in FIGS. 5, 6, 7, 8*a* and 8*b*. These lines extend longitudinally down the housing interior and are coupled to the high pressure block 39. They enter the main vertical tube 25 from block 39. Line 49*a* enters just below the tube gear 23*h* at coupling 49*b*. Line 51*a* enters the main vertical tube 25 just below at coupling 51*b* and the sonic air line 53*a* enters closest to the nozzle assembly at coupling 53*b*.

Lines 49*a*, 51*a* and 53*a* are parallel to the cylindrical housing axis and are disposed towards the periphery of the housing 57. They are protected from the gear train by the gear plate 59. These lines serve not only to feed the fluids through the unit but also to reinforce the unit assembly. The couplings 49*b*, 51*b*, 53*b* are so disposed that the fluid must enter the coupling at right angles. This 90° turn in the moment of forces tends to reduce the parallelograms of force acting within the unit to zero.

HORIZONTALLY ROTATING MAIN VERTICAL TUBE

Figure 9:
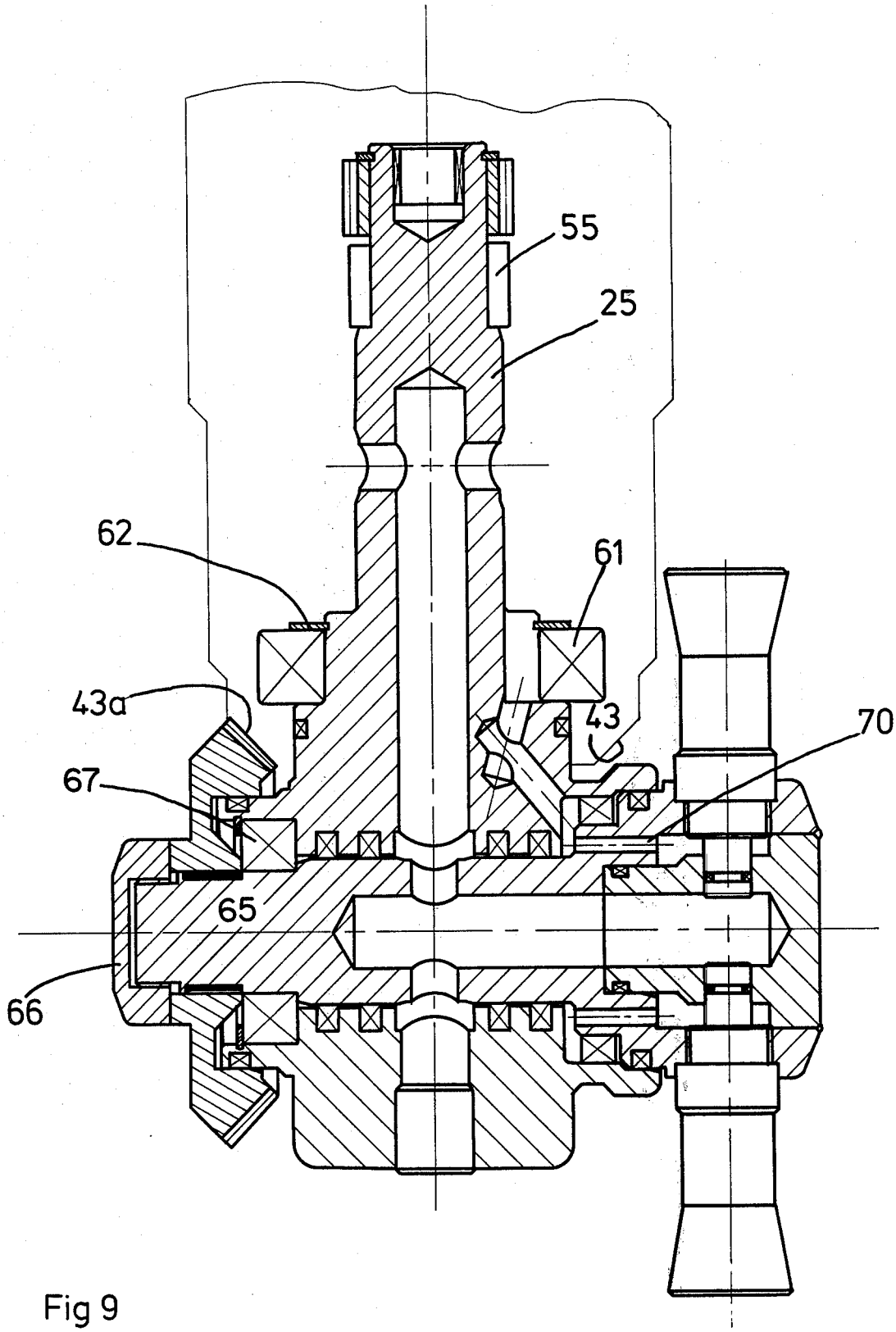
FIG. 9 is a cross-sectional view of the components rotating in the horizontal plane; and, FIG. 10 in a similar cross-sectional view presents the components rotating in the vertical plane.
Figure 10:
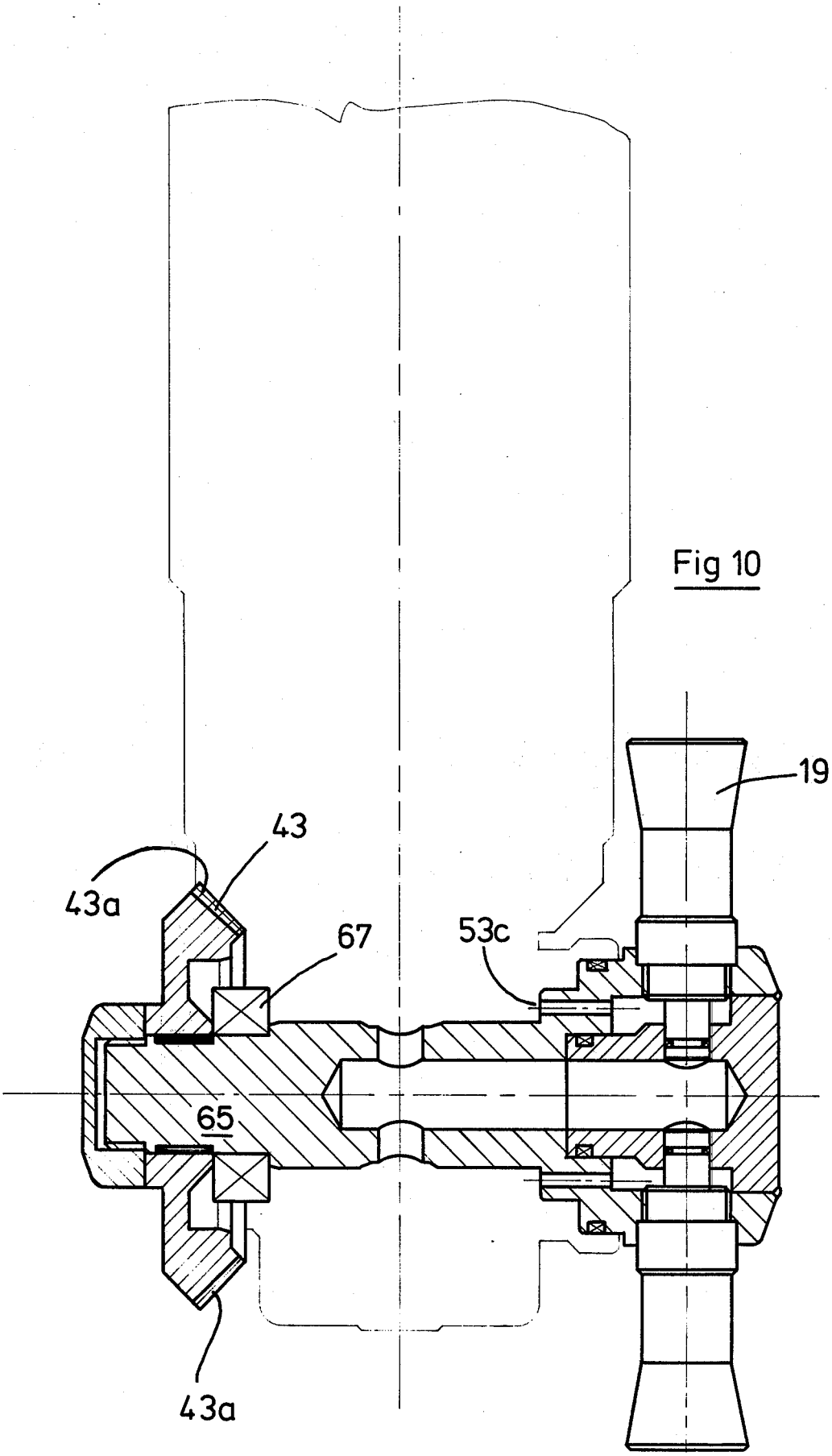

The main vertical tube 25 which rotates in the horizontal plane is shown in FIG. 9 and is held in place by high pressure block 39. Rotational drive is provided by gear 23*h*. The main vertical tube 25 is supported by two widely spaced and substantial bearings. The needle bearings 55 close to the input drive from gear 23*h*, and, bearing 61 which provides the main axial and radial location. The bearing 61 is a close fit into the bevel housing and this and the bearing are all clamped together by a snap ring 62, and six screws 64. A joint or gasket is fitted between the high pressure block and the bevel housing gear 43 of the high pressure block 39. Main vertical tube 25 has a central high pressure passage which as hereinbefore stated is coupled to feed tubes 49*a* and 51*a*. The sonic air feed tube 53*a* travels along another path. Coupling of the liquid feed tubes 49*a* and 51*a* is at couplings 49*b* and 51*b*. The central high pressure passage 63 feeds these liquids to the next stage. The main vertical tube 25 is a welded fabrication in a substantially T-shape. Machined into the end is the housing to hold the assembly for rotating the two sonic nozzles 19. Four grooves are machined to take seals. The sizes are exactly the same as the other seals and venting holes are also provided.

THE ROTATING NOZZLE ASSEMBLY

This next stage is the horizontal nozzle assembly 27 which turns in the vertical plane and is attached to the end of the main vertical tube 25. The nozzle assembly 27 at the outer end of block 39 consists of a nozzle tube 65 with an end cap 66 holding rotating bevel gear 43*a* meshing with bevel housing gear 43. The nozzle tube 65 fits into the main vertical tube and is supported by two widely spaced bearings. The first bearing 67 is a standard single row unit fitted with grease retaining seals. At the other end, loose rollers 6 MM diameter run in a grease lubricant. The bearing 67 is retained by snap ring 68 and the bevel wheel gear 43*a* is locked on the end of the nozzle tube 65 by the end cap 66; an o-ring prevents the entry of liquid from outside, and also prevents the cap from becoming unfastened.

The bevel gear 43*a* meshes with the bevel gear housing 43 and when the central tube 65 is rotated by the gear train, the nozzle tube is rotated in the horizontal plane about the vertical center line axis. It is also turned in the vertical plane by the action of the bevel gears 43, 43*a*. The nozzles are therefore rotated in two planes. The number of teeth in the two bevel gears 43, 43*a* are not the same; one has 65 teeth, the other 66. This one tooth difference causes the jet from the nozzles to step around the pitch of one tooth each rotation, thus giving more dense coverage of the tank surface being cleaned.

The nozzle tube 65 is fabricated in two parts, and the second end cap is welded into place. The sonic nozzles 19 are supplied with two separate fluids and therefore require two separate routes for this supply. The high pressure, or presolve liquid travels through the center of the nozzle tube and divides into two paths to feed each nozzle. The second path is for the sonic air. This is fed down feed tube 53*a* into space 53*b*. This is an annular groove. From here the air enters a hole through the main vertical tube 25 and into another annular groove 53*c*. Circumferential holes 70 are drilled into the nozzle tube 65 to supply air finally into the sonic nozzles 19.

Apart from the seal materials and the bearings, all parts are substantially made of stainless steel type AISI304. The air motor is purchased separately as a complete unit. The overall weight is some 22 pounds.

OPERATION OF THE INVENTION

When cleaning an enclosed vessel, the sonic generator operates in two different modes: the presolve mode and the high pressure mode. For the presolve mode, the unit is lowered into the tank being cleaned. Through hose connections, air with oil entrained is supplied to the air motor to cause rotation. The pressure controls the motor speed. All the fluids are fed through the inlet end 17. The presolve liquid is fed by hose to the connection 51 and continues down the feed tube 51*a* through the high pressure block 39 and into the main vertical tube 25. It then enters nozzle tube 65 and is finally fed to each of the sonic nozzles 19 to emerge through the center orifice in the nozzle. At the same time the sonic air is supplied through a separate hose connected to the feed tube connection 53 held by a bolt. This oil free air is fed through the high pressure block 39 into the annular space 53*a* as hereinbefore described, then through main vertical tube 25 to space 53*c* and to the sonic nozzles. The effect of this air is to break up by sonic action the streams of the presolve liquid into a vapor of 10 micron size particles. This fills the tank being cleaned and softens the residues clinging to the internal surfaces of the tank. The unit is rotating at the same time at approximately 6½ rpm. The average usage of the presolve liquid is some 2–5 gallons only. On completion of the presolve phase the sonic air and the presolve supply are switched off. For the high pressure mode, the supply of air to the motor is continued and the unit revolves as before. The high pressure liquid is fed down the feed tube 49*a*, and continues along the path followed by the presolve and again to emerge from the center of the sonic nozzle. The jet issues in the form of a narrow cutting stream which removes the residues softened by the presolve phase.

Figure 8A:
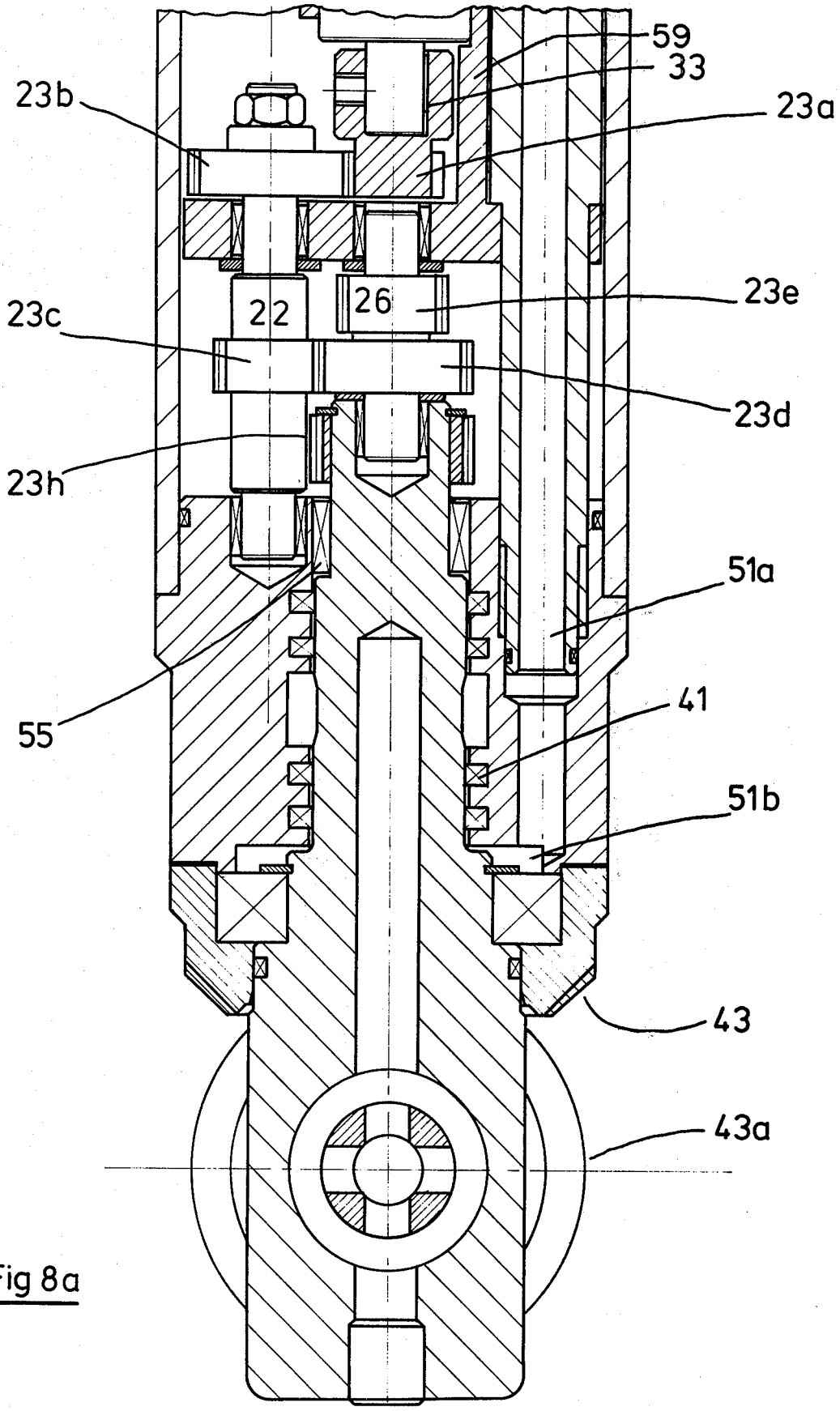
FIG. 8*a* shows a portion of a longitudinal cross-sectional view of the unit showing one portion of the gear train.
Figure 8B:
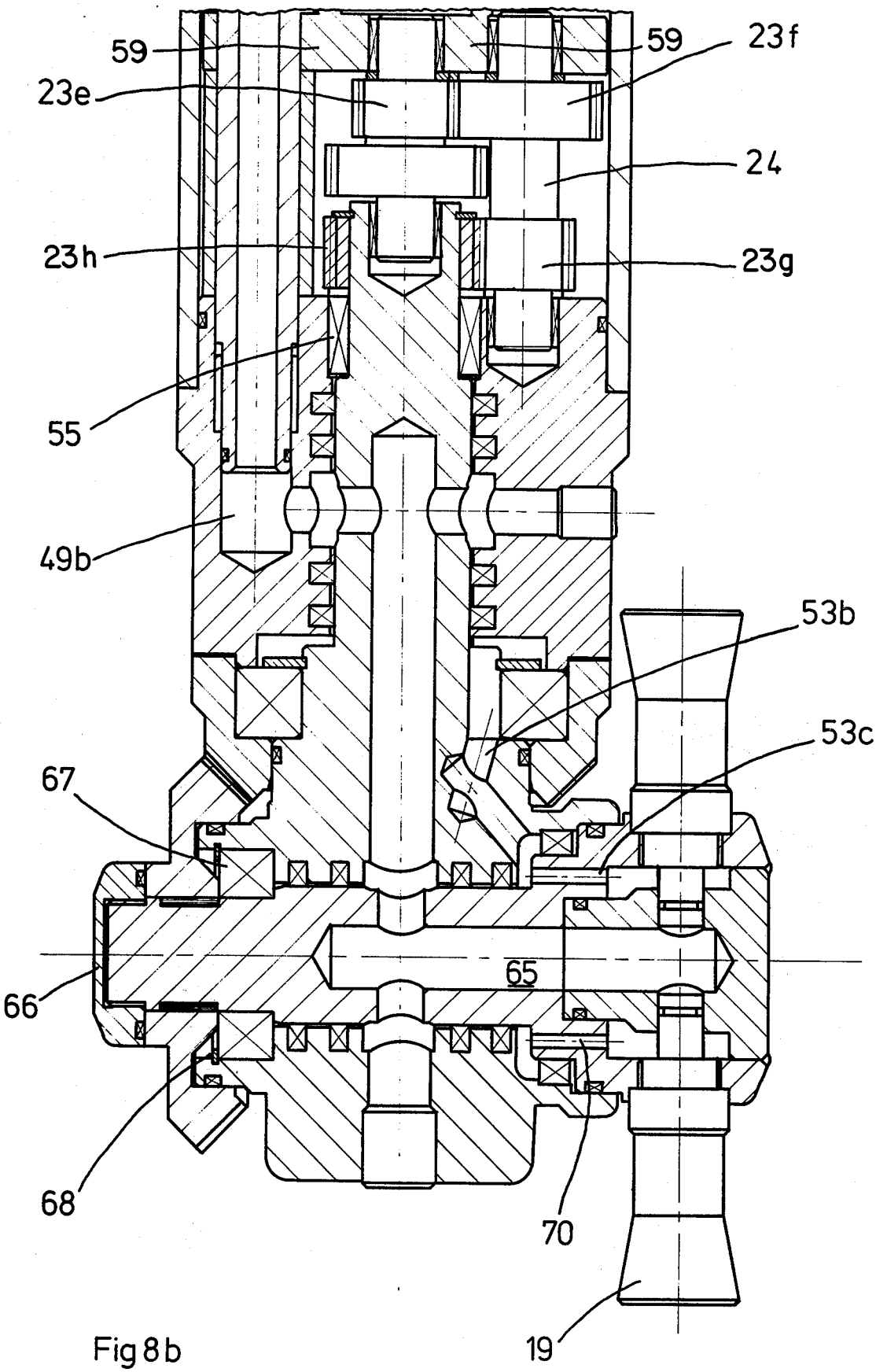
FIG. 8*b* is a view similar to FIG. 8*a* but turned at right angles from FIG. 8*a* showing the remaining components of the gear train.

Although in theory the maximum operating pressure on the high pressure side is 2500 psi, in view of both the likelihood of high peaks due to shocks in the system and the trend towards higher pressures generally, the unit is designed to be capable of operating at pressures of up to 10,000 psi. As heretofore pointed out, the unit must be capable of entering the smallest tank opening and this limits the outer diameter to under six inches. Therefore, the use of conventional bearings is not possible. The bearings have to be small so as to support only the weight of the mechanism. The other forces must be balanced out by the action of the fluids themselves. As shown in FIG. 8*a* and FIG. 8*b*, the gear train must be perfectly balanced with substantially equal numbers of gears and pinions on each side of the central shaft and along the central shaft. Also, the fluid flow must be such that the component of moment of forces of the axial hydraulic forces is substantially zero. The arrangement depicted in the drawings of the unit show that the supply of liquid is fed through a tube offset from the center line axis. Since the barrel of the unit is only four inches in diameter this means that it is difficult to get a tube large enough within this cross-section to supply the liquid required. For this reason, two tubes are used and these tubes not only supply the liquid but also hold the unit together.

An innovation in the present concept is that the bevel gear wheel 43*a* is on the end opposite the nozzles. In the devices of the prior art, the bevel wheel gear was on the same side as the nozzles. Also fitted at this side were the main bearings and the seals. This produced a large overhanging mass which is neither mechanically sound nor easy to reduce in size to fit the small holes these units have to go through. In the present arrangement, the nozzle tube 65 is taken right through the bottom housing, the bevel gear is on the rear end and the bearings are spaced out along the length. The size is reduced, sound mechanical principles are observed and the hydraulic systems balance. With the bottom arrangement in the form of a "T", the nozzle axis is at right angles to the inlet axis. Therefore, the design of the present unit differs from the units of the prior art described in the aforementioned G. Watts U.S. Pat. Nos. 3,281,269 and 3,401,060, in the following respects:

(a) All hydrostatic forces due to internal liquid pressure are completely balanced, there are no residual forces acting along either of the two main axes. This means that the bearings are not subject to high loads and have only to support the weight of the parts themselves which is small.

(b) The bevel gear is fitted to the nozzle tube at the end opposite to the nozzles. This reduces the size and improves the support given to the tube by the bearings.

(c) The feed tubes are used to both hold the unit together, and to feed the three different fluids to the nozzles. This simplifies the layout and reduces the overall size.

(d) The sonic airflow is fed through the unit to the nozzles despite the balanced rotation of the nozzles about two axes.

What is claimed is:

1. In an apparatus using high pressure fluids for cleaning tanks having an elongated cylindrical housing with an upper fluid inlet portion and a lower portion having a rotating cylindrical main vertical tube journaled for rotation in said lower portion, a bevel housing gear at the lower end of said lower portion, a nozzle assembly attached to said rotating cylindrical main vertical tube including spray nozzles at the outer end of said nozzle assembly and a bevel gear coupled to said nozzle assembly in mesh with said bevel housing gear, the improvement therein wherein said nozzle assembly includes an elongated nozzle tube disposed at right angles to said rotating cylindrical main vertical tube, said spray nozzles being at one end of said nozzle tube, said nozzle assembly bevel gear being at the other end of said nozzle tube, wherein said main tube is concentric with said housing, wherein said apparatus further comprises means symmetric with respect to said main tube for rotating said main tube and thereby rotating said nozzle assembly, and means for defining a plurality of separate passageways for feeding different types of fluids to said spray nozzles.

2. An apparatus as claimed in claim 1 including at said lower portion a high pressure block with a central elongated axial aperture, said passageway defining means including a plurality of feed tubes held by said block parallel to said central axis aperture, fluid couplings between said rotating cylindrical main vertical tube and said feed tubes so disposed that the fluid flow into and out of the couplings is at right angles.

3. An apparatus as claimed in claim 1 wherein said rotating means includes an air motor drive pinion centrally located towards said upper fluid inlet portion, a central gear and pinion shaft and first and second gear and pinion shafts disposed adjacent and parallel to said central shaft, a gear train disposed on said shafts, and, a driven gear on said rotating cylindrical main vertical tube coupled to said gear train.

4. An apparatus according to claim 3, wherein said rotating cylindrical main vertical tube has a recessed upper end portion for receiving a lower end of said central gear and pinion shaft.

5. An apparatus according to claim 3, wherein said lower portion of said housing includes a high pressure block having a central elongated axial aperture, and wherein said high pressure block has recessed portions for receiving lower ends of said first and said second gear and pinion shafts.

6. An apparatus as claimed in claim 1, wherein said plurality of separate passageways includes a passageway for feeding a sonic fluid to said nozzle assembly, said nozzle assembly having a groove spaced from the elongated nozzle tube in fluid communication with the passageway, the groove feeding the sonic fluid to said spray nozzles.

7. An apparatus according to claim 1, wherein said passageways are symmetrically arranged within said housing, and wherein separate passageways are provided for feeding a high pressure fluid, a presolve fluid, and a sonic fluid.

8. An apparatus according to claim 7, where said lower portion of said housing includes a high pressure block having a central elongated axial aperture in fluid communication with said elongated nozzle tube, and wherein said high pressure fluid passageway and said presolve fluid passageway are in fluid communication with said elongated axial aperture.

9. An apparatus according to claim 8, wherein said nozzle assembly includes a groove spaced from said elongated nozzle tube and wherein said sonic fluid passageway is in fluid communication with said groove.

10. An apparatus according to claim 1, wherein said spray nozzles extend at right angles to said elongated nozzle tube.

* * * * *